United States Patent [19]

Hayakawa et al.

[11] Patent Number: 4,934,003

[45] Date of Patent: Jun. 19, 1990

[54] DEVICE FOR TRANSFERRING THE DISABLED

[75] Inventors: Kiyoshi Hayakawa; Takao Arai; Osamu Tanaka; Hiroshi Iijima; Hiroki Suzuki; Fumiyuki Matsuno; Kenji Misugi, all of Kanagawa, Japan

[73] Assignee: Echo Corporation, Kanagawa, Japan

[21] Appl. No.: 304,776

[22] Filed: Jan. 31, 1989

[30] Foreign Application Priority Data

Feb. 1, 1988 [JP] Japan ..... 63-21587
Jun. 21, 1988 [JP] Japan ..... 63-153180

[51] Int. Cl.[5] ..... A61G 7/10

[52] U.S. Cl. ..... 5/81 R; 5/508; 414/921; 297/DIG. 10

[58] Field of Search ..... 5/81 R, 81 B, 508; 414/921; 182/230, 116; 297/DIG. 10

[56] References Cited

U.S. PATENT DOCUMENTS

| | | | |
|---|---|---|---|
| 2,757,388 | 8/1956 | Chisholm . | |
| 2,963,713 | 12/1960 | Forrest | 5/81 R |
| 2,975,435 | 3/1961 | Forrest | 5/81 R |
| 3,041,636 | 7/1962 | Twedt | 5/81 R |
| 3,165,314 | 1/1965 | Clearman | 5/81 R |
| 4,279,043 | 7/1981 | Saunders | 5/81 R |
| 4,510,633 | 4/1985 | Thorne | 5/81 R |
| 4,656,679 | 4/1987 | James | 5/81 R |

FOREIGN PATENT DOCUMENTS

| | | | |
|---|---|---|---|
| 2445764 | 4/1976 | Fed. Rep. of Germany . | |
| 2614528 | 11/1988 | France | 5/81 R |
| 71517 | 1/1916 | Switzerland . | |

*Primary Examiner*—Alexander Grosz
*Assistant Examiner*—F. Saether
*Attorney, Agent, or Firm*—Bachman & LaPointe

[57] ABSTRACT

A disabled transferring device comprises a stationary base and a rotary base coupled with the stationary base for forming a base assembly. An actuation lever assembly which has an actuation lever having a pivot point in the vicinity of one end and an actuation point at the other end, is pivotally supported on the rotary base of the base assembly. A pivotal support shaft is secured onto the level in the vicinity of the pivot point in such an arrangement that the securing point of the pivotal support shaft is oriented at the pivot point or between the one end and the pivot point with a first distance to the pivot point of the lever. The first distance is much shorted than a second distance between the pivot point and the actuation point. A saddle to mount thereon the disabled is mounted on the top end of the support shaft. The support shaft is pivotable between a tilted position with the saddle for placing the saddle on the chest or brest of the disabled and the vertical position at which the angular displacement of the shaft and saddle is caused to the angular position where the chair, bed, vehicular seat or so forth to transfer the disabled is oriented.

12 Claims, 9 Drawing Sheets

DEVICE FOR TRANSFERRING THE DISABLED

BACKGROUND OF THE INVENTION

1. Field of the Invention

The present invention relates generally to a device for transferring the disabled in such an occasion when the disabled or aged people is to be transferred from a bed to a wheel chair, or from a wheel chair to an automobile and so forth. More specifically, the invention relates to a device for transferring the disabled, which requires less power for operation so that a lady or child can operate to transfer the disabled.

2. Description of the Background Art

Nowadays, population who are handicapped or significantly aged and are not capable of standing or walking by themselves, is increasing according to extension of human life and development of medical technologies. Some heavily disabled require assistance of a nurse or helper in such an occasion that the disabled is to be shifted from a bed to a wheel chair or from wheel chair to an automobile. In many cases, such severely disabled are not capable to stand by themselves. Therefore, in order to transfer such disabled, substantial power is required for the nurse or helper assisting him. Difficulty is often encountered in transferring such severely disabled because full of his weight may be loaded to the assistant, such as nurse or helper, when he is to be transferred. The disabled and aged people set forth above will be hereafter referred to as "patient", through out the disclosure.

In order to assist transferring of the patient, it is one of conventional technology to transfer the patient to lift the patient by a hoisting mechanism which has a belt or canvas to suspend the body of the patient. Such lifting mechanism is relatively large and expensive. Furthermore, mechanism is generally stationarily facilitated and cannot be carried, the area to use such mechanism is substantially limited. In addition, in such hoisting mechanism, the belt is usually weared at the hip or back of the patient, removable of the belt at the transferred position becomes difficult in some occasion, for example when the patient is to be transferred from the wheel chair to a chamber pot.

Another the patient transferring technology which has conventionally been used, is a scooping mechanism which scoop up the patient by inserting a scoop under the body of the patient. Such scooping mechanism is hardly used for transferring the patient in the wheel chair.

Because of such defects in the conventional art, assisting for the patient in transferring him from one position to the other position is done manually. This is substantially hard work and requires substantial power to support the patient and to transfer him from the desired position. As set forth, many of the assistants, such as nurses or helpers, face difficulty in working for transferring the patient.

SUMMARY OF THE INVENTION

In view of the above, it is a principle object of the present invention to provide a device for transferring the patient, which enables to transfer the patient from one position to the other position without substantial manual power.

Another object of the invention is to provide the handicapted transferring device which is simple in construction and thus in low price.

A further object of the invention is to provide the patient transferring device which can be conveniently carried to any place.

In order to accomplish the aforementioned and other objects, a patient transferring device, according to the present invention, comprises a stationary base and a rotary base coupled with the stationary base for forming a base assembly. An actuation lever assembly which has an actuation lever having a pivot point in the vicinity of one end and an actuation point at the other end, is pivotally supported on the rotary base of the base assembly. A pivotal support shaft is secured onto the level in the vicinity of the pivot point in such an arrangement that the securing point of the pivotal support shaft is oriented at the pivot point or between the one end and the pivot point with a first distance to the pivot point of the lever. The first distance is much shorted than a second distance between the pivot point and the actuation point. A saddle to mount thereon the patient is positioned the top end of the support shaft. The support shaft is pivotable between a tilted position with the saddle for placing the saddle on the chest or breast of the patient and the vertical position at which the angular displacement of the shaft and saddle is caused to the angular position where the chair, bed, vehicular seat or so forth to transfer the patient is oriented.

According to one aspect of the invention, a device for transferring a patient who has a difficulty of self-standing, such as the heavily patient or aged patient, from a first orientation to a second orientation, comprises:

a saddle contacting with a body of the patient and mounting thereon the patient;

a support shaft supporting the saddle at the top thereof, the support shaft being pivotable between a substantially vertical first position and a tilted second position, the tilting position being adapted for receive the patient on the saddle at the first orientation and releasing the patient from the saddle at the second orientation;

a turntable assembly including a turntable rotatable for causing angular displacement at least between the first orientation and the second orientation; and a pivot mechanism mounted on the turntable and pivotally supporting the support shaft for allowing pivotal movement of the support shaft between the first position to the second position.

Preferably, the pivot mechanism includes a foot pedal with a pivotal lever associated with the support shaft for pivotal movement according to pivotal movement of the support shaft between the first and second positions. The pivotal lever is pivotable about a pivot point which shifts to expand lever length thereof according to pivotal movement from the first position to the second position.

In the preferred construction, the transferring device further comprises a lock mechanism for locking the pivotal lever for preventing the support shaft from pivotally moving from the first position. The lock mechanism is associated with a lock releasing mechanism for releasing lock mechanism for allowing pivotal movement of the pivotal shaft for allowing pivotal movement of the support shaft from the first position to the second position.

The support shaft may be adjustable of the length for adjusting height position of the saddle. Furthermore, the turn table assembly may be provided with a caster which is not active while the patient is transferred.

In the further preferred construction, the pivotal lever has a longer leg having a tip end on which the foot pedal is provided, and a shorter leg having a tip end contacting with the mating surface of the turn table for forming the pivoting point during pivotal movement of the pivotal lever. The longer leg and the shorter leg are intersecting at an intersection with a given angle. The pivotal lever is supported for pivotal movement about a pivot shaft at the intersection for pivotal movement from the first position to a third position intermediate between the first and second positions, and the tip end of the shorter leg serves as pivoting point for pivotal movement of the pivotal lever between the third position to the second position.

The saddle may be formed with a pair of side sections directly contacting with the body of the patient and a stepped down center section which is maintained away from the body.

BRIEF DESCRIPTION OF THE DRAWINGS

The present invention will be understood more fully from the detailed description given herebelow and from the accompanying drawings of the preferred embodiment of the invention, which, however, should not be taken to limit the invention to the specific embodiment but are for explanation and understanding only.

In the drawings.

DESCRIPTION OF THE PREFERRED EMBODIMENT

Figure 1:
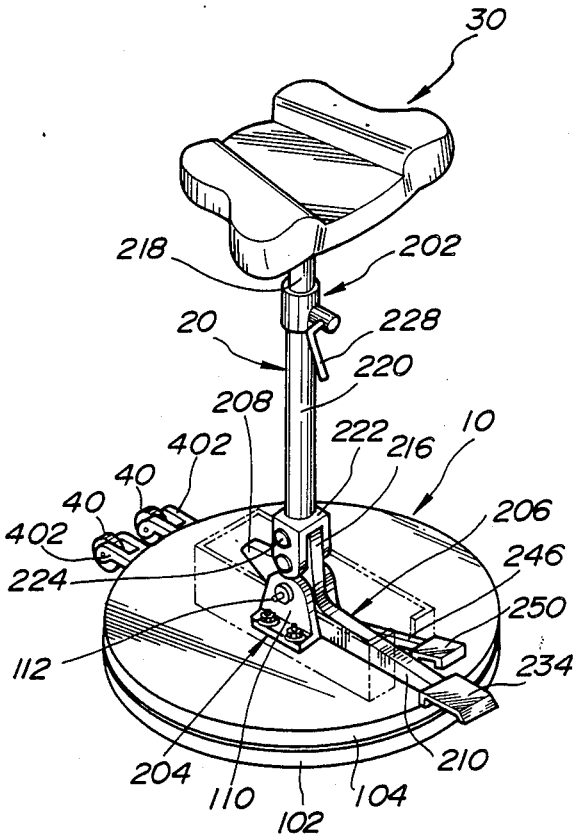
FIG. 1 is a perspective view of the preferred embodiment of a device for transferring the patient, according to the present invention.
Figure 2:
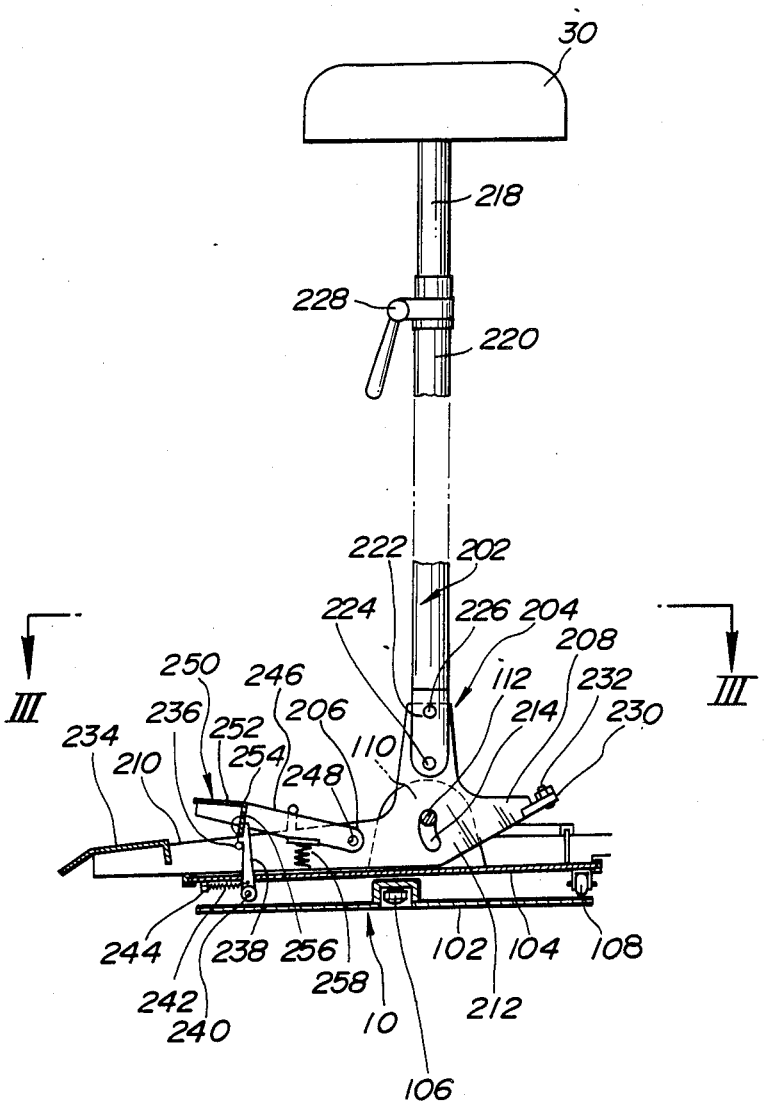
FIG. 2 is an enlarged and partly sectioned side elevation of preferred embodiment of the transferring device of FIG. 1.
Figure 3:
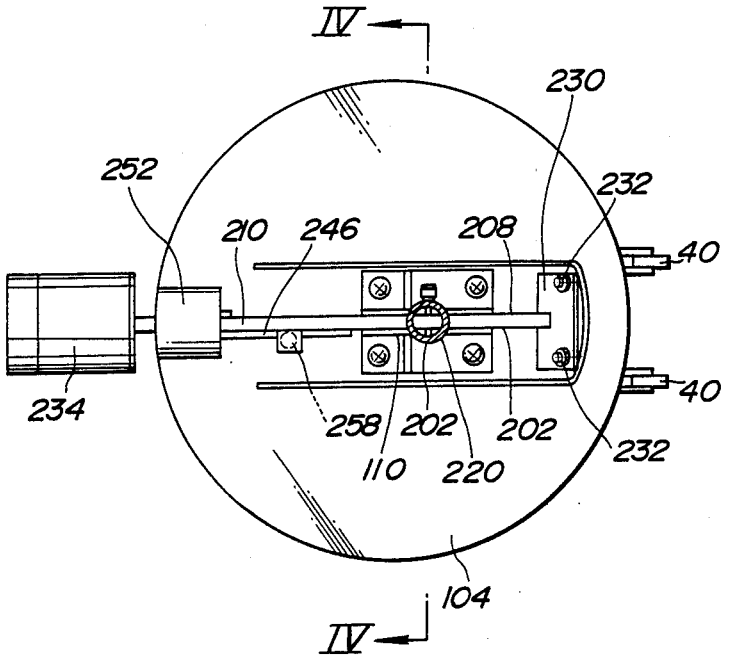
FIG. 3 is a plan view of a rotary base assembly as shown in a form that the upper part of the transferring device is cut-away at a line III—III of FIG. 2.
Figure 4:
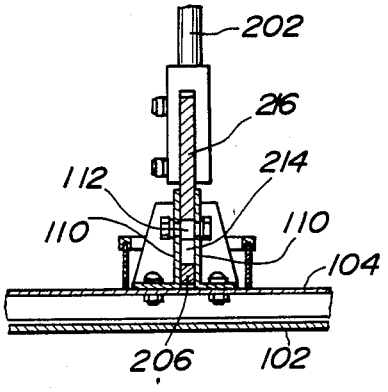
FIG. 4 is a section taken along line IV—IV of FIG. 3.

Referring now to the drawings, particularly to FIGS. 1 and 2, the preferred embodiment of a device for transferring the patient generally comprises a rotary base assembly 10, a pivotal support assembly 20 and a saddle 30 on which the patient rides when he is transferred from one position to the other position.

The rotary base assembly 10 comprises a stationary base 102 and a rotary base 104. Both of the stationary base 102 and the rotary base 104 are formed into circular disc shaped configurations. The rotary base 104 is rotatably supported on the stationary base 102 for rotation about a pivot 106. One or more rollers 108 is provided on the lower surface of the rotary base 104 in the vicinity of the cirumferential edge thereof so as to assist smooth rotation thereof with respect to the stationary base 102. With the shown construction, the rotary base 104 is rotatable about the pivot 106.

The pivotal support assembly 20 is mounted on the rotary base 104 of the base assembly 10 for angular displacement with with respect to the stationary base 102. The pivotal support assembly 20 includes a support shaft which is generally represented by the reference numeral 202, and a pivot mechanism which generally represented by the reference numeral 204. The pivot mechanism 204 comprises a pivotal level 206 which has a shorter leg 208 and a longer leg 210 intersecting at a pivoting section 212. The pivoting section 212 of the pivotal level 206 is pivotally supported on the rotary base 104 by means of a mounting bracket 110 for pivotal movement about a pivot 112. As seen from FIG. 1, an arc-shaped elongated opening 214 is formed in the pivoting section 212, through which the pivot 112 engages.

A vertical extension 216 is formed and extended upwardly from the pivoting section 212. The support shaft 202 comprises an upper shaft 218 and a lower shaft 220 coaxially arranged to each other. The lower shaft 220 is provided a bifurcated lower end 222. The bifurcated lower end 222 engages with the vertical extension 216 and is pivotally secured thereto by means of fastening bolt 224. Therefore, the shaft 202 is pivotable with respect to the lever. A keying pin 226 is removable engaged to through the bifurcated lower end 222 of the lower shaft 220 and the vertical extension 216 so as to fix the lower shaft 220 to the vertical extension 216. Therefore, as long as the keying pin 226 is active to maintain fixed relationship between the lower shaft 220 with the lever, the support shaft 202 is pivoted with respect to the pivot with the pivotal lever 204. On the other hand, at an occasion, such as for transportation, the keying pin 226 is removed so as to allow pivotal movement of the support shaft 202 about the fastening bolt 224 relative to the pivotal lever 204.

The upper shaft 218 mounts the saddle 30 at the top thereof. The upper shaft 218 is slidingly disposed in the lower shaft 218 so as to allow adjustment of the height level of the saddle 30. An upper shaft stop mechanism (not shown) with a wring lever 228 is provided at the top of the lower shaft 220 for firmly securing the upper shaft 218 at the adjusted height position so as to maintain the saddle 30 at the desired height.

To the pivotal lever 204 is rigidly secured a strip 230 extending from the tip end of the shorter leg 208. The strip 230 extends laterally to the pivotal lever 204. Adjusting screws 232 are engaged to the strip 230 and extends downwardly therefrom. On the other hand, a pedal 234 is rigidly secured on the tip end of the longer leg 210 of the pivotal lever 206. A locking pin 236 extends laterally from the side surface of the longer leg 210 of the pivotal lever 206. As particularly seen from FIG. 2, the locking pin 236 is oriented at a position intermediate between the tip end where the pedal 234 is provided and the pivoting section 212. Though the orientation of the locking pin 236 can be selected at any intermediate position between the tip end of the longer leg 210 and the pivoting section 212, it is preferred to place the locking pin 236 at an orientation in the vicinity of the tip end. The locking pin 236 is engageable with a locking hook 238 which is pivotable about a pivot 240. The locking hook 238 is normally biased toward the locking pin 236 by means of a compression spring 242 which has one end engaged to the locking hook and the other end engaged to a downwardly extending strip 244 extended from the lower surface of the rotary base 104.

A lock release lever 246 is pivotally mounted on the pivotal lever 206. The lock release lever 246 is pivotable about a pivot 248 engaged at the end oriented in the vicinity of the pivoting section 212. At the other end remote from the pivoting section, a lock release pedal 250 is rigidly secured. The lock release pedal 250 is formed into generally channel shaped configuration to have an essentially horizontal pedal section 252 and an essentially vertically extending actuating section 254 mating with a tapered edge 256 of the locking hook 238. The lock releasing lever 246 is, on the other hand, biased upwardly by means of a compression spring 258 in a counterclockwise direction in FIG. 2. Counterclockwise movement of the lock releasing lever 246 is limited by means of a stopper 260.

As seen from FIG. 1, a pair of casters 40 are provided on the base assembly. The casters 40 are supported on essentially horizontal brackets 402. The casters 40 are normally held away from the ground as long as the base assembly 10 is held parallel to the ground or floor as shown in FIG. 2.

Figure 5:
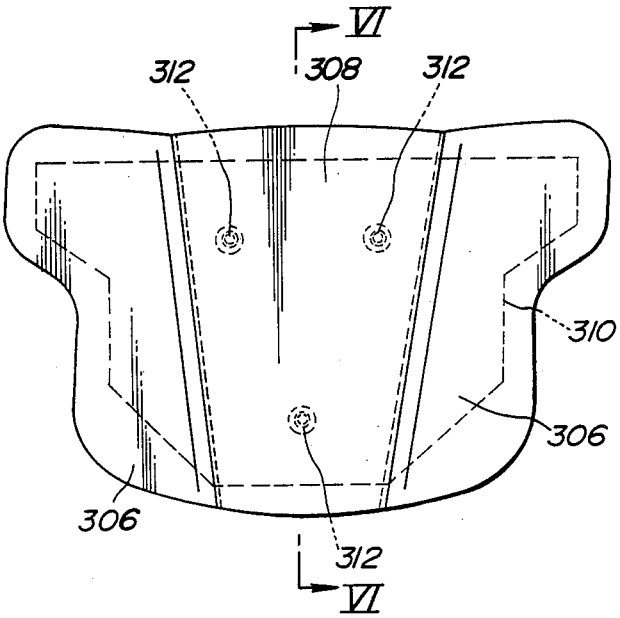
FIG. 5 is a plan view of a saddle of the preferred embodiment of the transferring device according to the invention.
Figure 6:
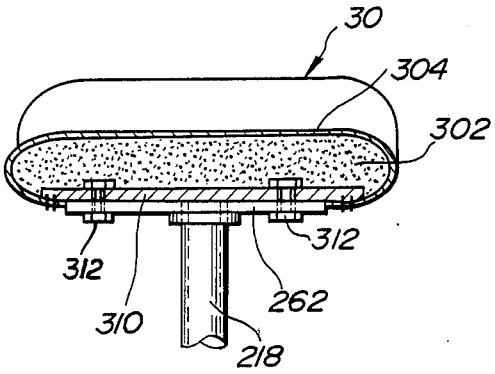
FIG. 6 is a section taken along line VI—VI of FIG. 5.

As seen from FIGS. 5 and 6, the saddle 30 comprises a relatively soft cushion 302 and an outer layer 304 surrounding the cushion 302. The saddle 30 is preferable formed into the shown configuration to have a side section 306 for directly contact with a chest or breast of the patient, and a stepped down center section 308 which is held away from the chest or breast of the patient. Such configuration is preferred, since the patient tends to support his almost all weight at the chest or breast contacting with the saddle 30 while he is transferred riding on the shown transfer device, whole contact of the breast and the saddle makes the patient tough in breathing due to substantial pressure loaded on the breast. The shown construction of the saddle 30 will advantageously leave non-contact center area for the breast of the patient for easy breathing.

The saddle 30 further has a support plate 310 attached on the underside of the saddle 30. The support plate 310 is secured on a top plate 262 provided on the top end of the upper shaft 218 by means of hand screws 312. With this construction, the saddle 30 can be easily removed from the upper shaft 218 by releasing the hand screws 312.

Though the shown construction of the saddle will be preferred in view of appearance and for providing easy breathing for the patient, the configuration or construction is not limited to the shown configuration and construction. Namely, though the shown embodiment has the stepped down center section 308, it is possible to omit the center section. Alternatively, it is also possible to remove the cushion 302 in the center section 308 and to leave only outer layer 304.

Practical transfer operation to be performed by means of the preferred embodiment of the transferring device set forth above, will be discussed herebelow with reference to FIGS. 7 and 8. As seen from FIG. 7, it is assumed at the patient sits on the bed, wheel chair, vehicular seat or so forth at the initial position. The transferring device is carried in front of the sitting patient. The transferring device is positioned to direct the longer leg 210 and the lock release lever 246 away from the patient.

At this position, the stationary base 102 is firmly set on the floor. For assuring firm setting of the stationary base 102 at the stationary position, it may be possible to provide a frictional material on the bottom of the stationary base. Then, the lock release pedal 250 is depressed by a foot of an assistant such as nurse, helper or so forth. Then the lock release pedal 250 shifts downwardly with maintaining contact between the actuating section 252 and the tapered edge 254 of the locking hook 238. This causes the locking hook 238 to pivotally move in clockwise direction in FIG. 2 to release locking engagement with the locking pin 236. Therefore, the pivotal lever 206 becomes free from restriction and becomes pivotable about the pivot 112 engaging with the arc shaped elongated opening 214 of the pivoting section 212.

At this position, the support shaft 202 with the saddle 30 is pivoted toward the patient. During this pivotal movement, the pivotal lever 206 upwardly pivots in an angle $\theta_1$, as shown in FIG. 8. Then, the pedal 234 reaches the position $P_1$. Pivotal movement of the pivotal lever 206, the saddle 30 is pivotally shifted in a magnitude of horizontal distance b and vertical distance $h_1$. At this position, the lower end of the adjusting screws 232 comes into contact with the mating surface of the rotary base 104. The contacting point p between the adjusting screws 232 and the rotary base 104 forms pivots for further pivotal movement of the pivotal lever 206 with the support shaft 202 toward the patient. This shifting of the pivot point from the pivot 112 to the contacting point p between the adjusting screws 232 and the mating surface of the rotary base 104 causes expansion of the lever length from the initial length a to the expended length a' which is longer than the initial length in a magnitude r as seen from FIG. 8. In the further pivotal movement about the shifted pivot point p, the pivotal lever 206 and the support shaft 202 further causes angular displacement in an angular magnitude $\theta_2$. This causes the saddle 30 to shift toward the patient in magnitudes of horizontal distance b' and vertical distance $h_2$. At this position, the pedal 234 is positioned at $P_2$.

At this position, the saddle 30 is positioned close to the patient. Then, the upper body of the patient falls down toward the saddle 30 to place the chest or breast on the side sections 306 of the saddle 30. The patient may, at this position, completely relaxed to load his weight as much as possible on the saddle. At this position, the assistant depresses the pedal 234 downwardly to cause pivotal movement in counterclockwise direction in FIGS. 7 and 8. At this time, since the pivotal lever 206 is provided the shifted pivot point p, power required for depressing the pedal 234 is substantially reduced so that ladies, such as nurse, lady helper, or even by a child can easily lift the patient up with the saddle.

During the pivotal movement, the pedal 234 reaches the point $P_1$. Further pivotal movement across which causes releasing of the adjusting screws 232 from the mating surface of the movable base 104. This causes shifting of the pivot point from the point p to the pivot 112. However, since this shifting of the pivoting point which causes shortening the lever length from a' to a occurs during pivotal movement, the change of required load for operating the pedal 234 will not substantial.

Figure 7:
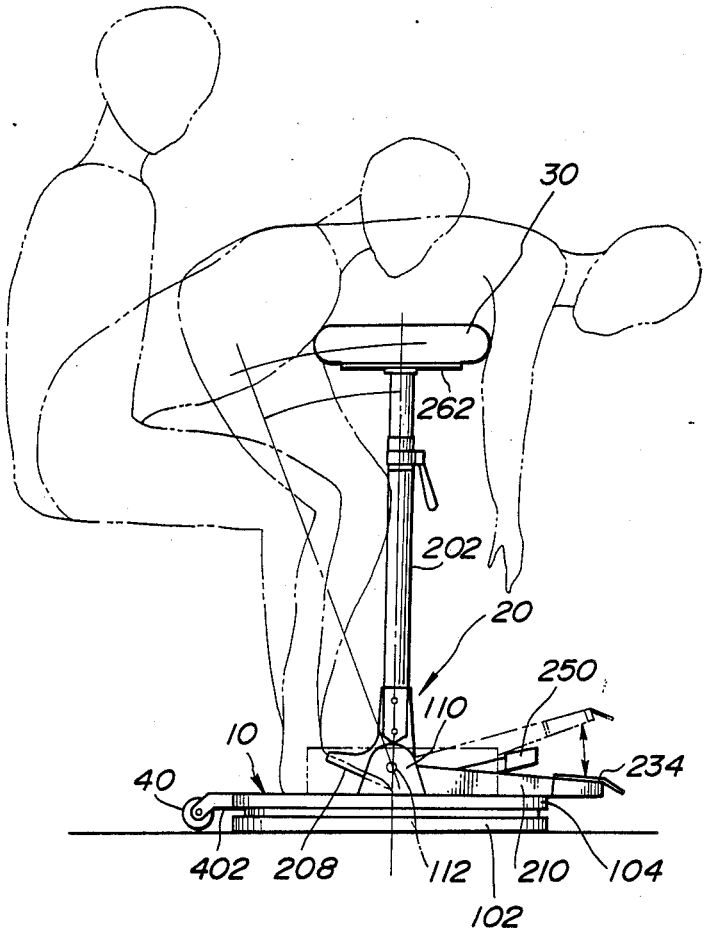
FIGS. 7 and 8 are illustrations showing manner of operation of the preferred embodiment of the transferring device to the invention.
Figure 8:
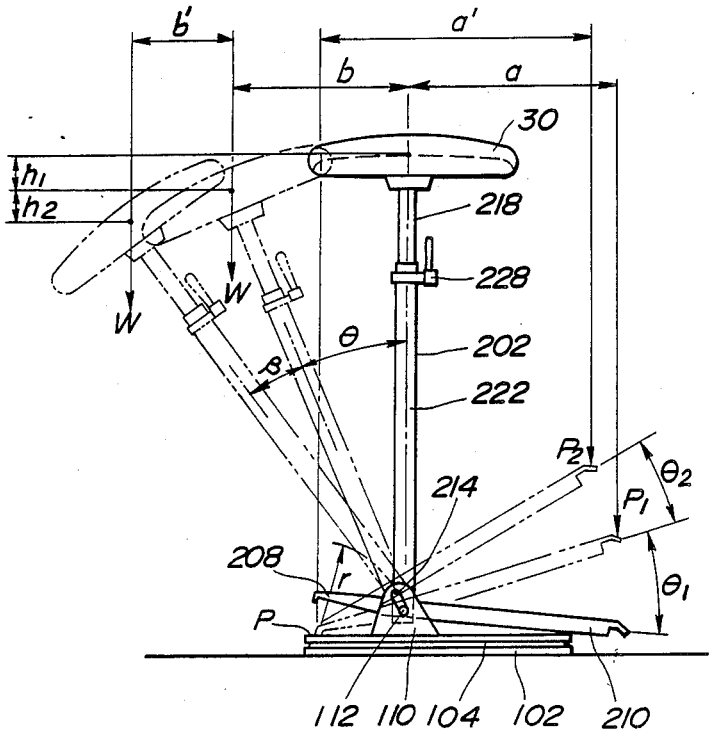

At the position where the support shaft 202 is placed vertical position as shown in FIG. 7, the locking hook 238 engages with the locking pin 236 for restricting pivotal movement of the pivotal lever 206. At this position, the rotary base 104 is rotated about the stationary base 102 for causing angular displacement of the patient. The rotation of the rotary base 104 is terminated at an angular position to the designated angle where the vehicular seat, the wheel chair, bed or so forth to transfer the patient is placed. Then, the lock releasing pedal 250 is again operated to release locking engagement between the locking hook 238 and the locking pin 236. Then, the support shaft 202 with the saddle 30 on which the patient is riding, is pivoted to the tilt position for placing the patient on the transferring destination. During this action, the assistant may control the tilting speed of the shaft 202 by loading a certain resisting force on the pedal 234. Even in such case, because of lever function, no significant force for controlling the tilting speed may be required.

Figure 9:
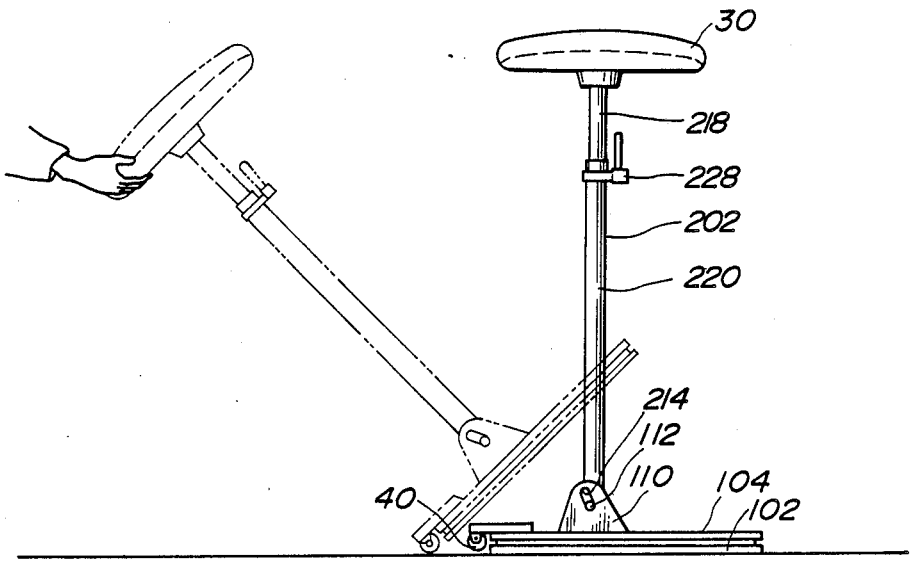
FIG. 9 is a side view showing manner of carrying the preferred embodiment of the transferring device according invention.
Figure 10:
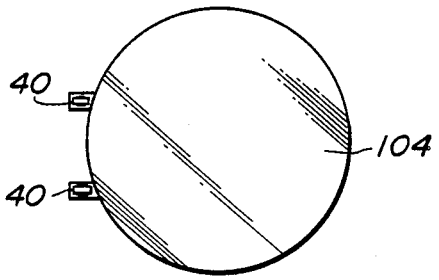
FIG. 10 is an explanatory plan view showing the rotary base caster for carrying.

When the preferred embodiment of the transferring device is carried with the patient, the saddle 30 can be easily removed from the top plate 262 of the upper shaft 218 by releasing the hand screws 312 without requiring any tool for disassembling. Furthermore, by removing the keying pin 226, the support shaft can be pivoted in a held position so that the device can be easily stored in a trunk of the automobile. Therefore, the device is easily carried to any where with the patient. Furthermore, when the device is to be moved in the assembled form, the whole device with the base assembly 10 is tilted to contact the casters 40 onto the ground or floor as shown in FIGS. 9 and 10. This substantially reduces force required for carrying the device.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments and modifications to the shown embodiments which can be embodied without departing from the principle of the invention set out in the appended claims.

Figure 11:
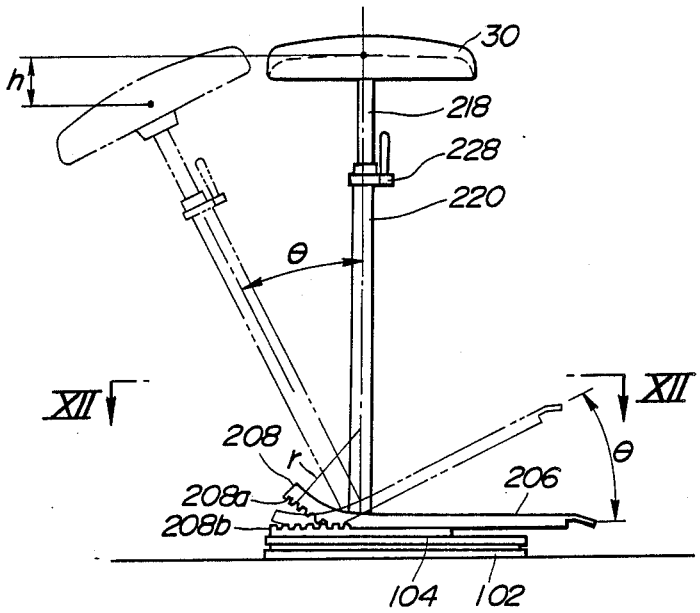
FIG. 11 is a side elevation of a modified embodiment of the transferring device according to the invention.
Figure 12:
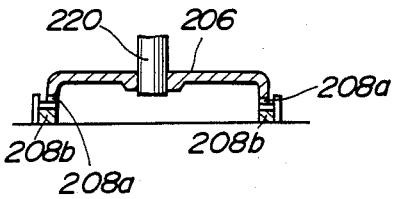
FIG. 12 is a section taken along line XII—XII of FIG. 11.

For example, though the preferred embodiment of the transferring device set forth above causes shifting of the pivoting point of the pivotal lever 206 between the pivot 112 and the shifted pivot point p, it is possible to continuously shifting the pivoting points during pivotal movement. FIGS. 11 and 12 show one example of implementation of continuous shifting of the pivoting point. In this case, a plurality of notchings 208' are formed on the lower edge of the shorter leg 208 which is formed in the arc shaped configuration with taking the radius r as shown in FIG. 11. In such case, the shorter leg 208 may be provided two notched legs **208*a* and 208*b* respectively engaging with notched members rigidly secured on the upper surface of the rotary base 104. In such case, the pivotal lever 206 is not provided in the pivoting section as that provided in the former embodiment. In addition, the support shaft 202 is simply inserted to a boss section formed in the lever 206**.

Figure 13:
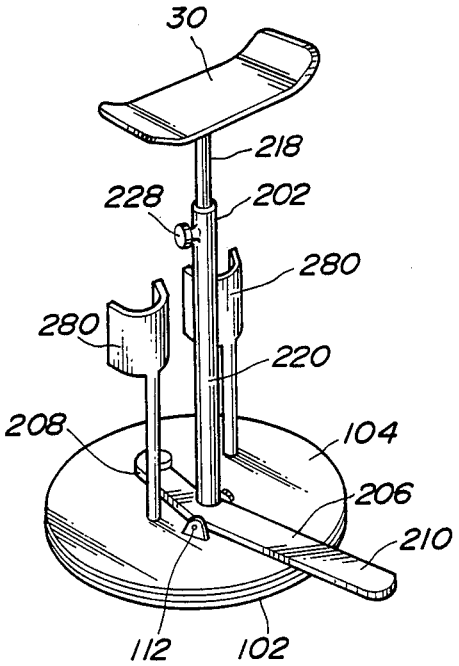
FIG. 13 is a perspectively view of another modification of the transferring device according to the present invention.
Figure 14:
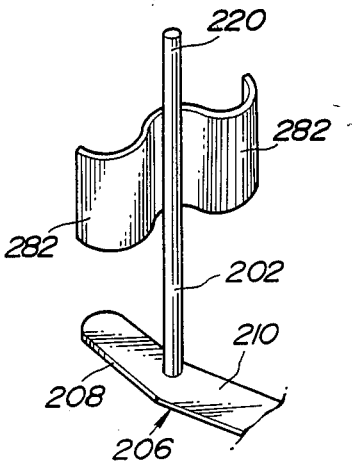
FIG. 14 is a perspective view of a further modification of the device of FIG. 12.

Furthermore, if desired, a knee support members 280 or 282 shown in FIGS. 13 and 14 may be provided for supporting the knee of the patient. Such knee support may assist for further reduction of the force required for transferring the patient from the bed, wheel chair, chair vehicular seat or so forth to the saddle of the device.

Figure 15:
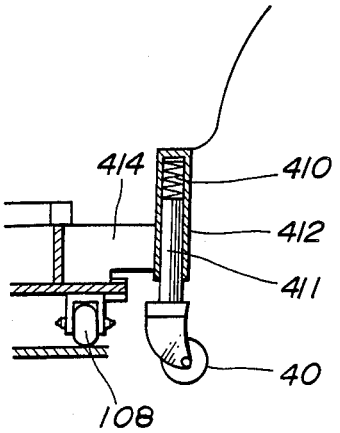
FIG. 15 is a modification of caster arrangement for enabling the preferred embodiment of the transferring device to be easily carried.

FIG. 15 shows another modification of the preferred embodiment of the transferring device according to the present invention set forth above. In the shown modification, the caster arrangement for enabling the transferring device to be easily carried has a caster 40 which has a stay 411 disposed in an essentially cylindrical housing 412 and being normally biased toward the ground or floor by means of a bias spring 410 housed within the housing 412. The housing is rigidly secured on the outer periphery of the rotary base 104 by a mounting bracket 414. The force of the spring 410 is so selected as to be overcome by the load applied to the saddle 30 so as to make the caster inoperative during the patient transferring operation. With this construction, the caster 40 is normally active for enabling the device to be carried with substantially smally force but enables to place the device stationarily while transferring of the patient is performed.

Therefore, the present invention fulfills all of the objects and advantages sought therefor.

What is claimed is:

1. A device for transferring a person who has a difficulty of self-standing, such as the heavily disabled or aged person, from a first orientation to a second orientation horizontally and angularly distanced from said first orientation, comprising:

a saddle contacting with a front portion of a body of said person and mounting thereon the person;

a support in a form of single bar and supporting said saddle at the top thereof, said support being pivotable at the lower end thereof for pivotal movement carrying said saddle between a substantially vertical first position and a tilted second position, said tilting position being adapted to receive said person on said saddle at said first orientation and releasing the person from said saddle at said second orientation;

a turntable assembly including a turntable rotatable for causing angular displacement at least between first and second angular positions respectively corresponding to said first orientation and said second orientation for causing angular displacement of said support; and a pivot mechanism mounted on said turntable and pivotally supporting the lower end of said support for allowing pivotal movement of said support between said first position and said second position.

2. A transferring device as set forth in claim 1, wherein said pivot mechanism includes a foot pedal with a pivotal lever associated with said support for pivotal movement according to pivotal movement of said support between said first and second positions.

3. A transferring device as set forth in claim 2, which further comprises a lock mechanism for locking said pivotal lever for preventing said support from pivotally moving from said first position.

4. A transferring device as set forth in claim 3, wherein said lock mechanism is associated with a lock releasing mechanism for releasing lock mechanism for allowing pivotal movement of said pivotal lever for allowing pivotal movement of said support from said first position to said second position.

5. A transferring device as set forth in claim 1, wherein said support is adjustable along its length for adjusting height position of said saddle.

6. A transferring device as set forth in claim 1, wherein said turntable assembly includes a caster which is not active while the person is transported from said first orientation to said second orientation.

7. A transferring device as set forth in claim 1, wherein said saddle is formed with a pair of side sections directly contacting with the body of said person and a stepped down center section which is maintained away from said body.

8. A device for transferring a person who has a difficulty of self-standing, such as the heavily disabled or aged person, from a first orientation to a second orientation, comprising:

a saddle contacting with a body of said person and mounting thereon the person;

a support supporting said saddle at the top thereof, said support being pivotable between a substantially vertical first position and a tilted second position, said tilting position being adapted for receive said person on said saddle at said first orientation and releasing the person from said saddle at said second orientation;

a turntable assembly including a turntable rotatable for causing angular displacement at least between said first orientation and said second orientation; and a pivot mechanism mounted on said turntable and pivotally supporting said support for allowing pivotal movement of said support between said first position to said second position, said pivot mechanism including a foot pedal with a pivotal lever associated with said support for pivotal movement according to pivotal movement of said support between said first and second positions, and said pivotal lever being pivotable about a pivot point which shifts to expand lever length thereof according to pivotal movement from said first position to said second position.

9. A transferring device as set forth in claim 8, wherein said pivotal lever has a longer leg having a tip end on which said foot pedal is provided, and a shorter leg having a tip end contacting with the mating surface of said turn table for forming said pivoting point during pivotal movement of said pivotal lever.

10. A transferring device as set forth in claim 9, wherein said longer leg and said shorter leg are intersecting at an intersection with a given angle.

11. A transferring device as set forth in claim 10, wherein said pivotal lever is supported for pivotal movement about a pivot shaft at said intersection for pivotal movement from said first position to a third position intermediate between said first and second positions, and said tip end of said shorter leg serves as pivoting point for pivotal movement of said pivotal lever between said third position to said second position.

12. A device for transferring a person who has a difficulty of self-standing, such as the heavily disabled or aged person, from a first orientation to a second orientation, comprising:

a body receptacle adapted to contact with the front portion of a body of said person and support the person thereon;

a singular bar support associated with said saddle for supporting said body said bar support forming a lever construction for pivotal movement between a substantially vertical first position and a tilted second position, said pivotal movement being adapted for causing vertical and horizontal displacement of said saddle and for bringing the saddle in the vicinity of or in contact with a chest portion of the person so as to receive said person on said saddle at said first orientation and bringing the person with said saddle to a desired position at said second orientation and releasing the person from said saddle at said second orientation;

a turntable assembly including a turntable rotatable for causing angular displacement at least between said first orientation and said second orientation;

a pivot mechanism mounted on said turntable and pivotally supporting the lower end of said support for allowing pivotal movement of said support between said first position to said second position; and a manual means for manual operation of said support for causing pivotal movement between said first and second positions.

* * * * *